United States Patent [19]

Tohma et al.

[11] Patent Number: 4,465,362

[45] Date of Patent: Aug. 14, 1984

[54] CLEANING DEVICE

[75] Inventors: Hitoshi Tohma; Tomohiro Kimura, both of Kawasaki; Hiroshi Ito, Yokohama, all of Japan

[73] Assignee: Canon Kabushiki Kaisha, Tokyo, Japan

[21] Appl. No.: 333,884

[22] Filed: Dec. 23, 1981

[30] Foreign Application Priority Data

Dec. 26, 1980 [JP] Japan ..... 55-187168

[51] Int. Cl.[3] ..... G03G 21/00

[52] U.S. Cl. ..... 355/15; 15/256.51; 118/652

[58] Field of Search ..... 15/1.5, 256.5, 256.51; 355/15, 3 R, 3 DD; 101/425, 157, 169; 118/652

[56] References Cited

U.S. PATENT DOCUMENTS

| | | | |
|---|---|---|---|
| 3,783,781 | 1/1974 | Grommek | 15/256.51 X |
| 3,848,992 | 11/1974 | Smith | 355/15 |
| 4,145,137 | 3/1979 | Sunaga et al. | 355/15 |
| 4,174,172 | 11/1979 | Lane | 355/15 |
| 4,278,345 | 7/1981 | Davis et al. | 355/15 |
| 4,364,660 | 12/1982 | Oda | 355/15 |

FOREIGN PATENT DOCUMENTS

| | | | |
|---|---|---|---|
| 83748 | 7/1978 | Japan | 355/15 |
| 99637 | 8/1979 | Japan | 355/15 |

*Primary Examiner*—R. L. Moses

*Attorney, Agent, or Firm*—Fitzpatrick, Cella, Harper & Scinto

[57] ABSTRACT

A cleaning device for removing any residual on an image bearing member has a cleaning member held in pressure contact with the surface of the image bearing member, and means for detecting the pressure contact condition of the cleaning member.

21 Claims, 4 Drawing Figures

CLEANING DEVICE

BACKGROUND OF THE INVENTION

1. Field of the Invention

This invention relates to a cleaning device, and more particularly to a cleaning device for removing any residual on the image bearing member of an image formation apparatus to make the image bearing member reusable.

2. Description of the Prior Art

Various types of image formation apparatus have heretofore been proposed in which a latent image is formed on an image bearing member such as a photosensitive medium on the basis of electrophotography or the like, the latent image is developed to provide a developed image, the developed image is transferred to a transfer medium, thereafter the residual developer on the surface of the image bearing member is removed to make the image bearing member reusable.

A blade cleaning system has been widely used as a system which is simple and very durable as the cleaning device for the image bearing member of the image formation apparatus described above.

In the blade cleaning system, it is necessary to cause the blade edge to bear against the surface of the image bearing member such as a photosensitive medium with a suitable pressure and at a suitable angle, and if this setting is not good, the surface of the image bearing member will abrade or damage, or the blade itself will abrade or damage.

Particularly, the material or physical property of the blade itself greatly contributes to the effectiveness of the cleaning, but in the past, the conditions have been empirically set with the aid of a simple measurement of the pressure or the like of the blade edge, however this has not always been sufficient.

Accordingly, if an adjustment is not made for variations in the cleaning conditions caused by abrasion or the like of the blade during use of the blade, there exists the possibility of sharply diminished cleaning. Again in such a case, the blade itself will be damaged, and sometimes even the surface of the image bearing member maybe damaged which will give rise to the necessity of replacing the image bearing member before its original period of use expires.

SUMMARY OF THE INVENTION

It is an object of the present invention to provide a novel and excellent cleaning device.

It is another object of the present invention to provide a cleaning device which can easily achieve the desired cleaning conditions.

It is still another object of the present invention to provide a cleaning device which can maintain good cleaning conditions for a long time.

The present invention consists in a cleaning device for removing any residual on an image bearing member, characterized by a cleaning member held in pressure contact with the image bearing member, and means for detecting the pressure contact condition of the cleaning member.

The set condition of the cleaning device can be detected by the above-described construction and therefore, even when the cleaning set condition is varied for any reason including a variation with time, the condition of that variation can be known and the cleaning device can be easily returned to a good cleaning set condition.

Other objects and features of the present invention will become apparent from the following detailed description of some specific embodiments of the invention taken in conjunction with the accompanying drawings.

DESCRIPTION OF THE PREFERRED EMBODIMENTS

Figure 1:
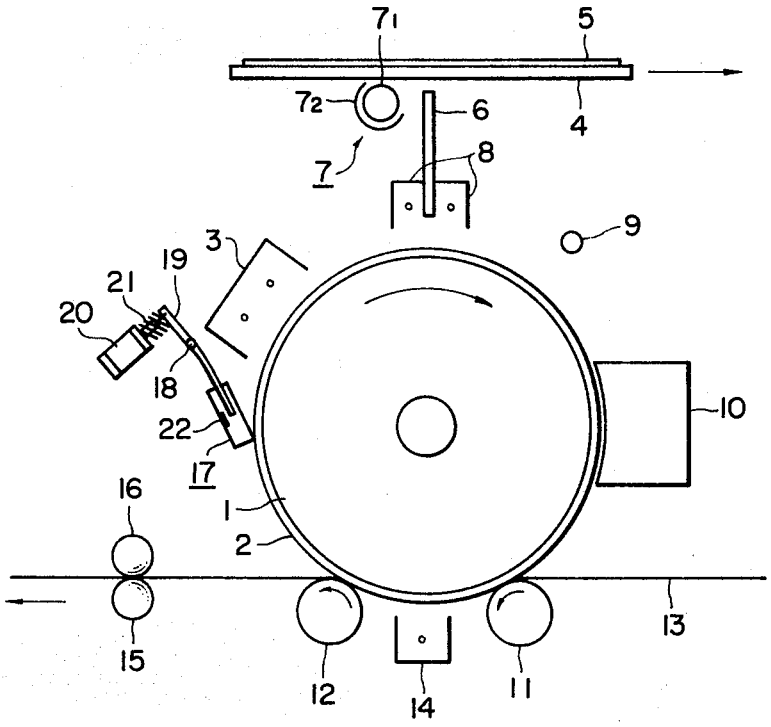
FIG. 1 is a side view of a specific example of an image formation apparatus to which the cleaning device according to the present invention is applied.

FIG. 1 is a side view illustrating a specific example of an image formation apparatus to which the cleaning device according to the present invention is applied.

In FIG. 1, reference numeral 1 designates a drum rotatively driven in the direction of the arrow shown, by a motor, not shown, and has on the periphery thereof a photosensitive medium 2 comprising an electrically conductive base layer, a photoconductive layer and a transparent surface insulating layer. The surface of the this photosensitive medium 2 is first uniformly charged by a corona discharger 3, the polarity of the charge being positive when the photoconductor is an N type semiconductor and negative when the photoconductor is a P type semiconductor. Subsequently, the photosensitive medium 2 is exposed to the image of an original 5 placed on a transparent carriage 4 moved in the direction of the arrow shown in synchronism with the rotation of the drum 1 and at the same velocity as the peripheral velocity of the drum 1, and this image is formed on the photosensitive medium 2 by a short focus small imaging element array 6. The photosensitive medium 2 and the transparent carriage 4 are moved in a direction orthogonal to the rectilinear arrangement direction of the small imaging elements of the array 6. The area of the original 5 to which the element array 6 is opposed, namely, the area of the original 5 which is imaged on the photosensitive medium 2, is illuminated by an illuminating system disposed in proximity to the array 6. This illuminating system has a light source $7_1$ such as a halogen lamp and a reflector $7_2$ disposed behind the light source. The reflector $7_2$ reflects the light emitted from the light source $7_1$ which does not directly travel toward the area of the original opposed to the array 6 and causes such light to be directed to the same area.

The photosensitive medium 2 is subjected to the image exposure by the element array 6 while, at the same time, it is subjected to the discharging by an AC corona discharger or a corona discharger 8 opposite in polarity to the corona discharger 3, whereby a charge pattern corresponding to the optical image of the original 5 is formed on the photosensitive medium. The whole surface of the photosensitive medium is further subjected to uniform exposure by a lamp 9, whereby an electrostatic latent image of high contrast corresponding to the original is formed on the photosensitive medium. As shown, the exit end surface side of the array 6 is disposed in a space surrounded by the shield member of the discharger 8. Alternatively, the discharger 8 may be disposed near the same end side of the array 6. The latent image thus formed is visualized into a toner image by a developing device 10 of the magnet brush type or the like. This toner image is then transferred to transfer paper 13 fed from supply means, not shown, and brought into contact with the photosensitive medium 2 by rollers 11 and 12 and conveyed at the same velocity as the photosensitive medium. To enhance the image transfer efficiency, a charge opposite in polarity to the toner forming the developed image is imparted to the back side of the transfer paper 13 at the image transfer station, this charging being accomplished by a corona discharger 14. The toner image thus transferred to the transfer paper 13 is heated and is fixed by a pair of rollers 15 and 16 urged against the transfer paper, thereafter the transfer paper is conveyed into a container means, not shown.

The surface of the photosensitive medium after termination of the image transfer is cleaned by the cleaning device of the present invention, which will hereinafter be described more fully, so that any toner remaining thereon may be removed, thus becoming ready for another cycle of the image formation process. In the illustrated cleaning device, an elastic cleaning blade 17 is pivotably supported by a support shaft 18. The end portion of an arm 19 extending on the opposite side of this support shaft has a solenoid 20 connected thereto, which solenoid, when energized, rotates the arm counter-clockwise against the biasing force of a spring 21 and urges the elastic cleaning blade against the surface of the photosensitive medium 2 with a desired pressure force.

The elastic cleaning blade is designed such that the contact condition thereof can be adjusted in response to the detection of the blade contact condition which will hereinafter the described more fully. For example, the solenoid 20 is fixed to a movable bed which may adjustably be moved as required. Alternatively, the position whereat the arm provided on said blade support shaft is connected to the solenoid 20 may be made movable. Of course, these designs are not restrictive, but any mechanism capable of adjusting the pressure force may be adopted.

The present invention is also applicable to a so-called Carlson process electrophotographic apparatus which uses a photosensitive medium having no surface insulating layer as the photosensitive medium 2. In that case, the discharger 8 and the lamp 9 are unnecessary in FIG. 1.

Figure 2:
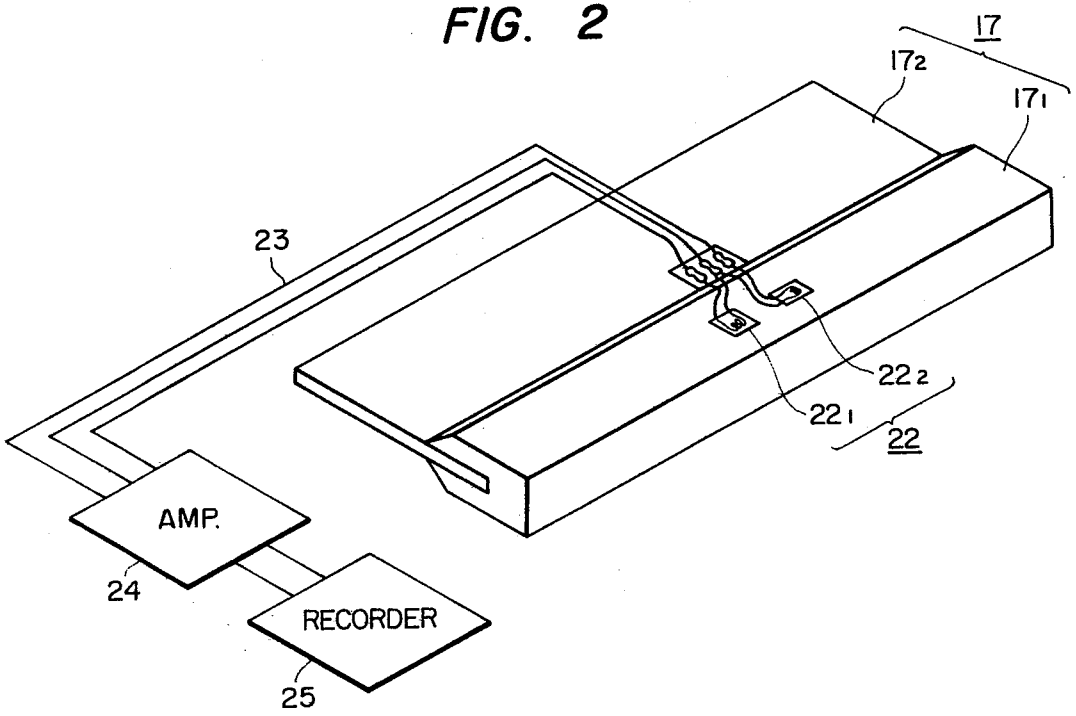
FIG. 2 is a perspective view of the cleaning portion of the cleaning device shown in FIG. 1.

FIG. 2 is a perspective view showing the essential portions of the elastic blade of the cleaning device shown in FIG. 1.

The elastic blade 17 comprises an elastic rod-like tip portion $17_1$ formed of a material such as rubber or synthetic resin and a metal sheet $17_2$. A strain detecting element 22 is secured to the tip portion. In FIG. 2, there are shown two elements, one of which is a strain detecting element $22_1$ and the other is a temperature correcting element $22_2$. The outputs of these elements are connected to an amplifier 24 by connecting lines 23 and the contact condition of the elastic cleaning blade is confirmed by reading means 25 such as a recorder.

When the value read by the reading means 25 deviates from an allowable value, the aforementioned blade contact condition adjusting mechanism is adjusted to make the read value by the reading means 25 into an allowable value. Thus, even after a long use of the apparatus, the cleaning device can always be set to its suitable condition.

The amplifier 24 and reading means 25 may be secured to the cleaning device body or may be removably constructed with respect to the device body so that they may be used only during maintenance check-up. In this latter case, the strain detecting element and the temperature compensating element are provided as required, and only the output terminals therefrom may be secured to the cleaning device body, and the amplifier and the reading means may be connected to those output terminals as required.

The position of the strain detecting element is not restricted to the center of the blade but may be arbitrary. Also, the number of the strain detecting elements is not restricted to one, but a plurality of such elements may be provided at a plurality of corresponding locations. Of course, in this case, the design of the plurality of such elements such that detections by these elements occur simultaneously or successively.

Figure 3:
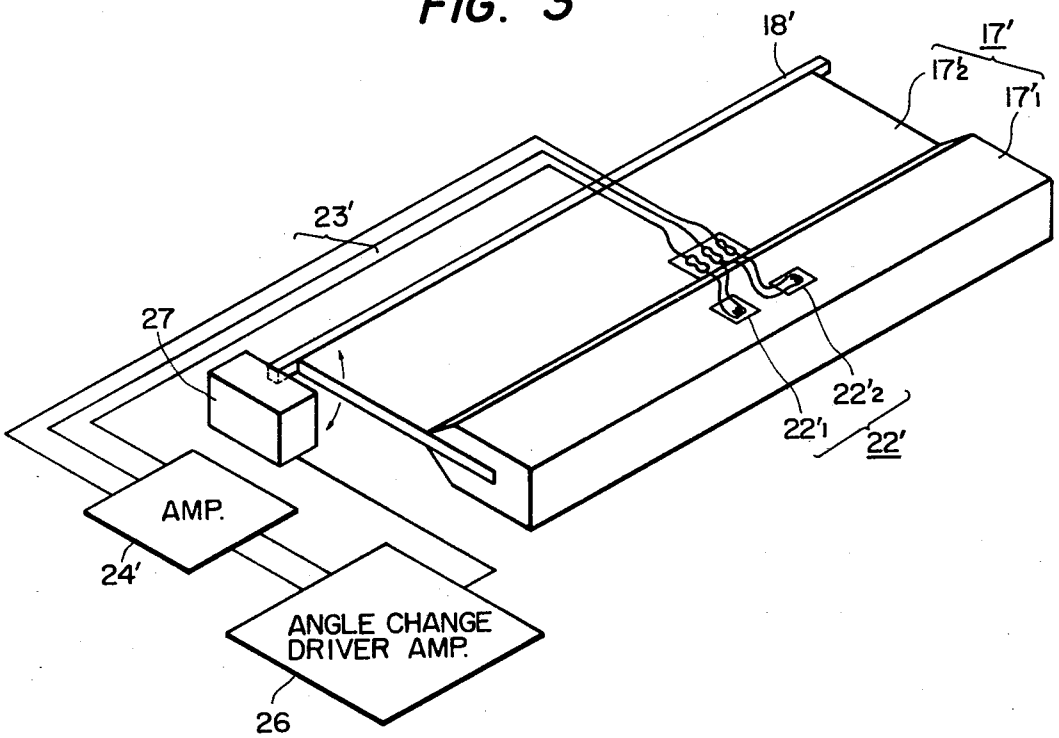
FIG. 3 is a perspective view of a modified cleaning portion.

FIG. 3 is a perspective view illustrating a modification of the cleaning device according to the present invention. In FIG. 3, members common to those in FIG. 2 are given identical numbers with a prime affixed thereto. The device shown in FIG. 3 is designed such that the blade contact condition is automatically corrected in response to the detection by the strain detecting element. The output of the strain detecting element 22' is amplified by the amplifier 24' and, where correction is required, the angle of rotation of a servomotor 27 mounted on the support shaft 18' of the blade is controlled by an angle change driver amplifier 26 so as to provide a predetermined pressure.

Of course, the pressure adjustment may be accomplished by adjusting the excitation force of the aforementioned solenoid or by using any other means.

Figure 4:
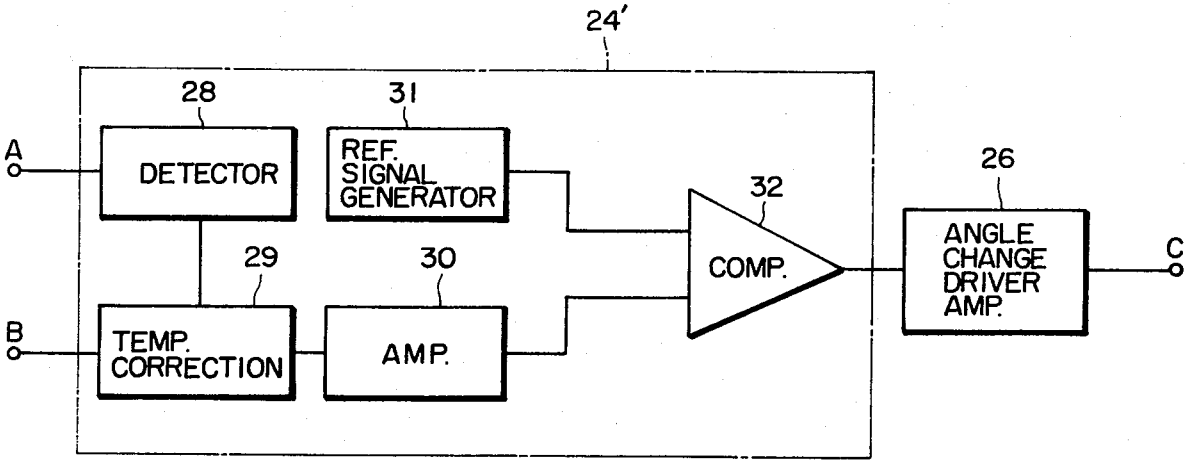
FIG. 4 is a block diagram of the control circuit of the FIG. 3 device.

FIG. 4 is a block diagram of the control circuit of the FIG. 3 device. A terminal A is an input terminal for receiving as input the detection signal $S_A$ from the strain detecting unit $22_1$. A terminal B is an input terminal for receiving as input the detection signal $S_B$ from the temperature compensating detecting element $22_2$. Designated by 28 is a detecting unit for detecting the strain detection signal $S_A$. Denoted by 29 is a temperature correcting unit for temperature-correcting the detection signal of the detecting unit in response to the detection signal of the temperature compensating detecting unit. Reference numeral 30 designates an amplifier unit for amplifying the temperature-corrected detection signal. Reference numeral 31 denotes a reference value signal generator for generating a present reference value signal. Designated by 32 is a comparator unit for comparing the aforementioned detection signal with the reference value signal, and it generates an angle change driving signal of the servomotor 27 when said detection signal is not coincident with the reference value signal. Denoted by 26 is an angle change driver amplifier for amplifying said driving signal.

Operation of the above-described control circuit will hereinafter be described. The detecting unit 28 detects the detection signal from the strain detecting element $22_1$, and the detection signal is corrected by the temperature corrected unit into a condition comparable with the reference value. The corrected detection signal is amplified by the amplifier unit 30 and applied as input to one input terminal of the comparator unit. The reference signal from the reference value signal generator 31 is applied as input to the other input terminal of the comparator unit.

If the elastic cleansing blade is in a predetermined pressure contact condition, the detection signal is coincident with the reference value signal and therefore, no output signal is generated from the comparator unit.

On the other hand, if the elastic cleaning blade deviates from the predetermined pressure contact condition for any reason including a variation with time, the detection signal is not coincident with the reference value signal and an output signal is generated from the comparator unit. This output signal is amplified by the angle change driver amplifier 26 and drives the servomotor 27 to adjust the elastic cleaning blade into the predetermined pressure contact condition.

In this manner, the cleaning device can always maintain its good cleaning condition.

To make the present invention better understood, some examples thereof will hereinafter be described.

EXAMPLE 1

At the lengthwise end of a phosphor bronze plate having a thickness of 0.15 mm, a width of 26 mm and a length of 315 mm, urethane rubber of rubber hardness 80° Hs(JISA) having the same length as the phosphor bronze plate and a thickness of 2.5 mm and a width of 6 mm was worked by unitary molding to provide a cleaning blade. For strain detection, two strain gauges (KFR-02-C1-11 produced by the Kyowa Dengyo Co., Ltd.) were provided on the urethane rubber portion of the cleaning blade in proximity to each other so that the detecting axes thereof are orthogonal to each other, one as the temperature correcting gauge and the other as the strain detecting gauge. An amplifier (DPH-110A produced by Kyowa Dengyo Co., Ltd.) was connected to one end of the strain gauge to detect a strain which occurred. As a photosensitive medium, a photoconductive layer having a film thickness of 40$\mu$ was formed on an aluminum cylinder of 80 $\phi$ having a length of 350 mm by a photoconductive paint comprising 100 parts by weight of CdS powder and 13 parts by weight of polyester resin (Bylon-200 produced by Toyobo Co., Ltd.) as binder resin, and was further covered with a thermally contracted tube of polyester film having a thickness of 22$\mu$. By the use of the photosensitive medium so obtained, test was carried out in the image formation apparatus of FIG. 1 with respect to a process comprising primary $\ominus$ DC charging, secondary AC discharging and simultaneous exposure, whole surface illumination, dry development by $\ominus$ toner and cleaning step by the previously described strain detection type urethane cleaning blade.

The toner used was a mixture of 100 parts by weight of styrene resin (produced by Japan Reichhold Co., Ltd.) and 50 parts by weight of fine magnetite powder heated and blended in a roll mill, ground by a jet air stream type grinder and classified by a wind power classifier so as to provide a particle diameter of 10–20$\mu$.

Very good cleaning could be maintained for a long period by choosing the mounting condition so as to minimize the amount of the strain created in the elastic cleaning blade.

EXAMPLE 2

When a urethane rubber blade having a thickness of 5 mm, a width of 28 mm and a length of 315 mm was unitarily molded, a pair of strain gauges similar to those of Example 1 were embedded in the center of the urethane rubber blade. In this manner, a urethane rubber blade of rubber hardness 70° Hs(JISA) obtained and cleaning test was carried out in the same image formation apparatus as that of Example 1.

Good cleaning could be maintained in a set condition which minimized the strain of the strain gauges embedded in the blade.

What we claim is:

1. A cleaning device for removing residual on a surface of an image bearing member of an image formation apparatus, comprising:

a cleaning member held in pressure contact with the surface of the image bearing member; and means for detecting the pressure contact condition of said cleaning member with respect to the surface of the image bearing member, said detecting means having a strain detecting element provided on said cleaning member; and means, responsive to said detecting means, for indicating a desired adjustment of the pressure contact condition of said cleaning member with respect to the surface of the image bearing member.

2. A cleaning device according to claim 1, wherein said detecting means has a plurality of strain detecting elements.

3. A cleaning device according to claim 1, wherein said detecting means has a temperature correcting element.

4. A cleaning device for removing residual on a surface of image bearing member of an image formation apparatus, comprising:

an elastic cleaning blade;

means for holding said elastic cleaning blade in pressure contact with the surface of the image bearing member; and means for detecting the pressure contact condition of said elastic cleaning blade, said detecting means having a strain detecting element provided on said elastic cleaning blade; and means, responsive to said detecting means, for indicating a desired adjustment of the pressure contact condition of said elastic cleaning blade with respect to the surface of the image bearing member.

5. A cleaning device according to claim 4, wherein said detecting means has a plurality of strain detecting elements.

6. A cleaning device according to claim 4, wherein said detecting means has a temperature correcting element.

7. A cleaning device for removing residual on a surface of an image bearing member of an image formation apparatus, comprising:

a cleaning member;

means for hold said cleaning member in pressure contact with the surface of the image bearing member;

means for detecting the pressure contact condition of said cleaning member; and means cooperable with said detecting means to control the pressure contact force of said cleaning member with respect to the image bearing member.

8. A cleaning device according to claim 7, wherein said control means has a control member connected to said cleaning member holding means.

9. A cleaning device according to claim 8, wherein said control member is a servomotor.

10. A cleaning device according to claim 7 or 8, wherein said detecting means has a strain detecting element.

11. A cleaning device according to claim 10, wherein said strain detecting element is provided on said cleaning member.

12. A cleaning device according to claim 4 or 7, wherein said holding means supports said cleaning member by a support shaft.

13. A cleaning device according to claim 7, wherein said detecting means has a temperature correcting element.

14. A cleaning device for removing residual on the surface of an image bearing member of an image formation apparatus, comprising:

an elastic cleaning blade;

means for holding said elastic cleaning blade in pressure contact with the surface of the image bearing member;

means for detecting the pressure contact condition of said elastic cleaning blade; and means cooperable with said detecting means to control the pressure contact force of said cleaning blade with respect to the image bearing member.

15. A cleaning device according to claim 14, wherein said detecting means has a strain detecting element.

16. A cleaning device according to claim 14, wherein said control means has a control member connected to said holding means.

17. A cleaning device according to claim 16, wherein said holding means supports said elastic cleaning blade by a support shaft and said control member of said control means is connected to said support shaft.

18. A cleaning device according to claim 17, wherein said control member is a servomotor.

19. A cleaning device according to claim 14 or 15, wherein said detecting means has a plurality of strain detecting elements.

20. A cleaning device according to claim 14 or 15, wherein said detecting means has a temperature correcting element.

21. A cleaning device according to claim 8 or 16, further comprising means for comparing a detection signal from said detecting means to a reference signal, said comparing means generating a driving signal to said control member.

* * * * *